US006202745B1

(12) United States Patent
Reimert et al.

(10) Patent No.: US 6,202,745 B1
(45) **Date of Patent: *Mar. 20, 2001**

(54) WELLHEAD APPARATUS

(75) Inventors: Larry E. Reimert, Houston; Charles E. Robinson, Katy, both of TX (US)

(73) Assignee: Dril-Quip, Inc, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 60 days.

(21) Appl. No.: 09/167,891

(22) Filed: Oct. 7, 1998

(51) Int. Cl.[7] ..... E21B 33/12

(52) U.S. Cl. ..... 166/115; 166/125; 166/208; 166/75.14

(58) Field of Search ..... 166/208, 182, 166/125, 115, 75.14; 285/123.12

(56) References Cited

U.S. PATENT DOCUMENTS

| | | | | |
|---|---|---|---|---|
| 4,053,023 | * | 10/1977 | Herd et al. | 175/7 |
| 4,757,860 | * | 7/1988 | Reimert | 166/208 |
| 4,781,387 | * | 11/1988 | Baugh | 166/382 |
| 4,836,288 | | 6/1989 | Wester | 166/348 |
| 5,163,514 | * | 11/1992 | Jennings | 166/368 |
| 5,544,707 | * | 8/1996 | Hopper et al. | 166/382 |
| 5,868,204 | * | 2/1999 | Pritchett et al. | 166/368 |

FOREIGN PATENT DOCUMENTS

| | | |
|---|---|---|
| 1 482 125 | 9/1974 | (GB) . |
| 2 270 940 | 3/1994 | (GB) . |
| 2 304 766 | 3/1997 | (GB) . |
| 2 201 444 | 9/1998 | (GB) . |

OTHER PUBLICATIONS

Search Report under Section 17 regarding Application No. GB 9923304.1 dated Apr. 12, 2000 conducted by Examiner Matthew Parker.

* cited by examiner

*Primary Examiner*—Hoang Dang
(74) *Attorney, Agent, or Firm*—Browning Bushman

(57) ABSTRACT

Wellhead apparatus is shown to comprise a casing hanger releasably latched to a running tool for lowering, landing and locking within the bore of a housing so as to suspend an inner casing which is suspended from the hanger within an outer casing string to which the housing is connected. The hanger includes a mandrel carrying a lock ring for locking in a recess in the housing bore, and a seal sleeve is carried by the mandrel for movement between an upper position to permit cement to be circulated through a space between the mandrel and a lower position closing the space. The tool includes a body carrying a latch ring which is held within a groove in the bore of the mandrel as the hanger is lowered and locked within the housing bore, and which may be actuated to lower the sleeve into sealed position and release the latch ring for retrieval of the tool, from the hanger within the well bore.

12 Claims, 9 Drawing Sheets

WELLHEAD APPARATUS

This invention relates generally to wellhead apparatus for use in suspending a casing string within another casing string or other well conduit suspended within the bore of an oil or gas well. More particularly, it relates to improvements in apparatus of this type wherein, during the drilling and completion of the well, a hanger connected to the upper end of an inner casing string is lowered into and landed and locked within the bore of a housing of the other hanger which is connected to the upper end of the outer string, whereby cement may be circulated upwardly through an annular space between the casing strings and hangers to anchor the inner casing within the well bore, and the space is closed by a seal assembly and the closure and then tested by means of test pressure above it. In another of its aspects, it relates to improvements in the tool or tools on which the hanger mandrel and seal assembly carried thereby are run into, landed, and locked within the well bore, and the seal assembly lowered to seal off the space, and the tool released from the hanger mandrel to permit testing of the seal retrieval of the tool from the well bore.

In order to minimize the cost of drilling and completing the well, the diameters of the well bore, and those of the casing strings, are as small as possible. Hence, it is important that the inner casing hanger, and its associated seal assembly, be of minimum radial thickness while nevertheless being able to support the load of the casing as well as pressure testing. This is a special challenge where it is necessary to support not only the weight of the casing string suspended from the hanger, but also the weight of another casing to be suspended within it, and it is the primary object if the inventor to provide apparatus which accomplish these purposes.

It is a further object to provide such apparatus which includes a running tool which enables the hanger to be landed and locked within the bore of the housing and the seal assembly installed within the space in only one trip.

These and other objects are accomplished, in accordance with the illustrated embodiment of the present invention, by wellhead apparatus which comprises a housing having a bore therethrough and a lower end connectible to an outer casing string for suspension within a well bore, an upwardly facing shoulder in the bore, a locking groove in the bore above the shoulder and having an upwardly facing load surface, and first fluid bypass means connecting with the bore above and below the groove. It further comprises a casing hanger which includes a mandrel having a bore therethrough and a lower end connectible to an inner casing string for suspension within the outer casing string, and a radially expandable and contractible locking ring carried about mandrel in a contracted position.

A downwardly facing cam surface is formed on the mandrel above the recess, and a sleeve is connected within the bore of the mandrel so as to land on the shoulder in the housing bore in order to initially locate the locking ring opposite the locking groove therein. The connection is releasable in response to downward movement of the mandrel and locking ring with respect to the housing to expand the ring into and hold it within the groove, whereby the load of the casing is transmitted through the hanger mandrel, to the locking ring, and from the locking ring to the housing.

The housing bore and mandrel form an annular space between cylindrical seal surfaces thereon which is an upward continuation of the first bypass means, and a sleeve carrying a aseal ring is connected about the hanger mandrel for vertical movement closely within the housing bore, in response to rotation of the sleeve, between an upper position in which the seal ring is above the annular space to permit circulation therethrough, and a lower position in which the ring is in sealing engagement with the seal surfaces to close the space. The bore of the housing also has second fluid bypass means outside the sleeve to form an upward continuation of the annular space, thus cooperating with the first fluid bypass means and space to provide a flow path for cement which is outside the hanger mandrel, whereby the hanger may be of minimal thickness, but nevertheless of such construction as to carry the loads to be described.

In accordance with one novel aspect of the invention, the hanger and running tool are of such construction as to enable the mandrel to be landed within and locked to the housing bore in only one run, and, for this purpose, the tool includes a body adapted to be suspended from a pipe string for rotation and vertical movement therewith within the well bore, and having a downwardly facing load surface for seating on the upwardly facing load surface of the mandrel. A radially expandable and contractible latch ring carried within a recess about the body has an upwardly facing load surface, and an expander is threadedly connected about the body and guidably movable within a slot in the hanger mandrel to cause the expander to be moved vertically, in response to rotation of the body, between an upper position in which the latch ring may contract and a lower position in which the latch ring is expanded and held within the groove.

In this position, an upwardly facing surface on the latch ring is engageable by a downwardly facing surface on the mandrel groove so as to carry the load of the casing string as it is lowered into the well with the tool. On the other hand, the tolerance of the latch ring and mandrel groove are such as to not transmit downward load to the hanger when the annular space is closed to permit pressure testing, as will be described to follow.

In accordance with another aspect of the present invention, the sleeve has a slot in its inner diameter to slidably guide a key carried by the tool body for rotation and vertical movement with it to lower the sleeve which is threadedly connected to the hanger mandrel. In the preferred and illustrated embodiment, the key is mounted on a collar which is carried on the tool body and on the lower end of which the downwardly facing load surface of the tool body is formed to seat on the upper end of the mandrel. As above noted, with the expander guidably slidable vertically within a slot in the inner diameter of the hanger mandrel, the expander is confined for vertical movement with respect to the tool body to enable the tool to both lock the hanger mandrel to the housing bore and lower the seal ring to close the space in one run.

In the drawings, wherein like references characters are used throughout to indicate like parts:

FIG. 1 is a vertical sectional view of apparatus constructed in accordance with illustrated preferred embodiment of the present invention, including a housing connected to the upper end of an outer casing string, and a casing hanger connected to the upper end of an inner casing string and latched about a running tool for lowering into an initial landed position within the bore of the housing to dispose a lock ring carried about the mandrel hanger opposite a locking groove in the housing bore, and with a seal sleeve carried about the mandrel in raised position to open the annular space between the hanger and the housing bore to the flow of cement;

Figure 1:
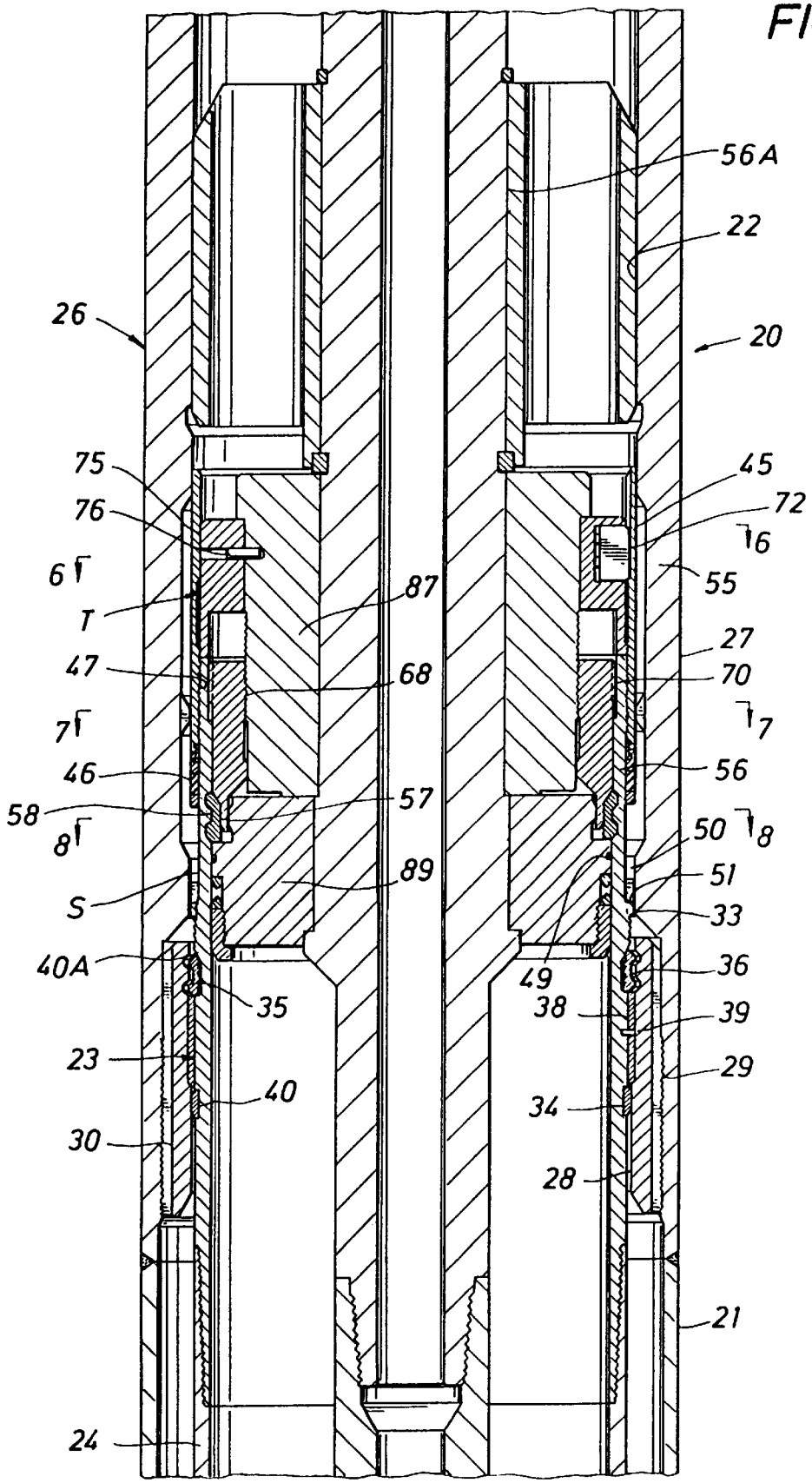
Figure 3:
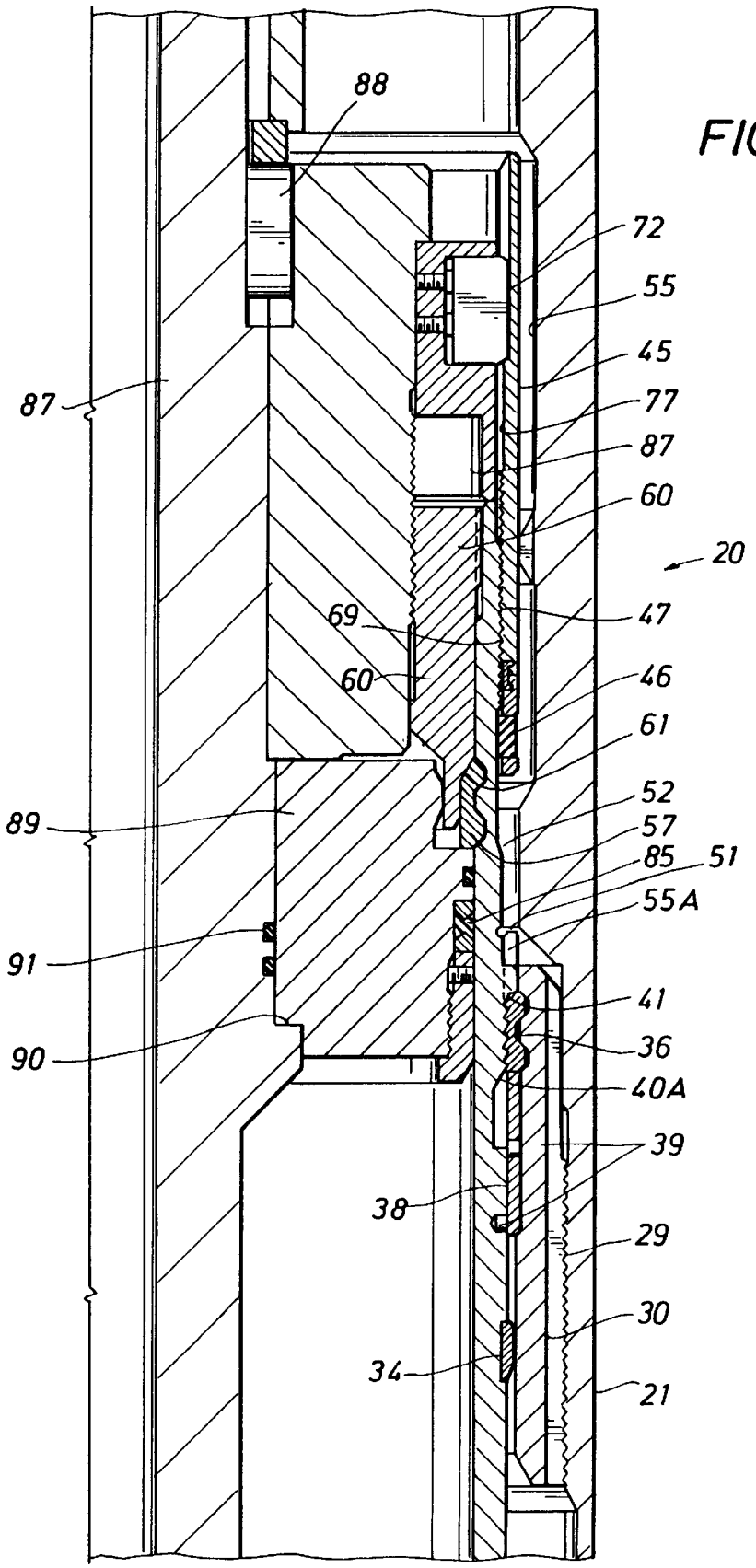
FIG. 3 is a view similar to FIG. 2, but wherein the hanger and locking ring have been lowered from an initial landed position to move the lock ring into and hold it within a locking groove in the bore of the housing to support the hanger and casing string therein.
Figure 4:
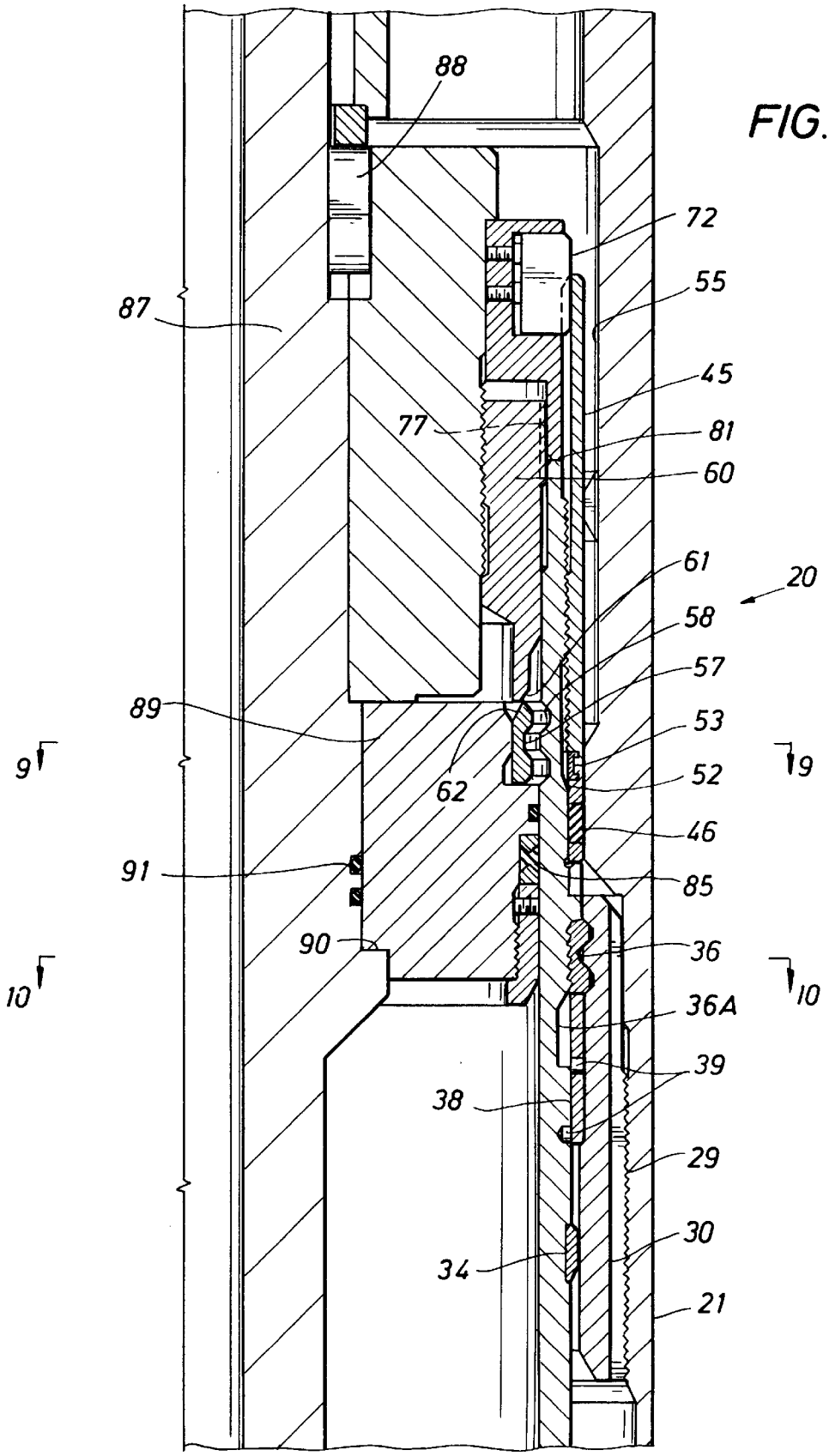
FIG. 4 is a view similar to FIG. 3A, but wherein the running tool has been further actuated to lower the seal ring into and cause it to seal across the annular space.
Figure 6:
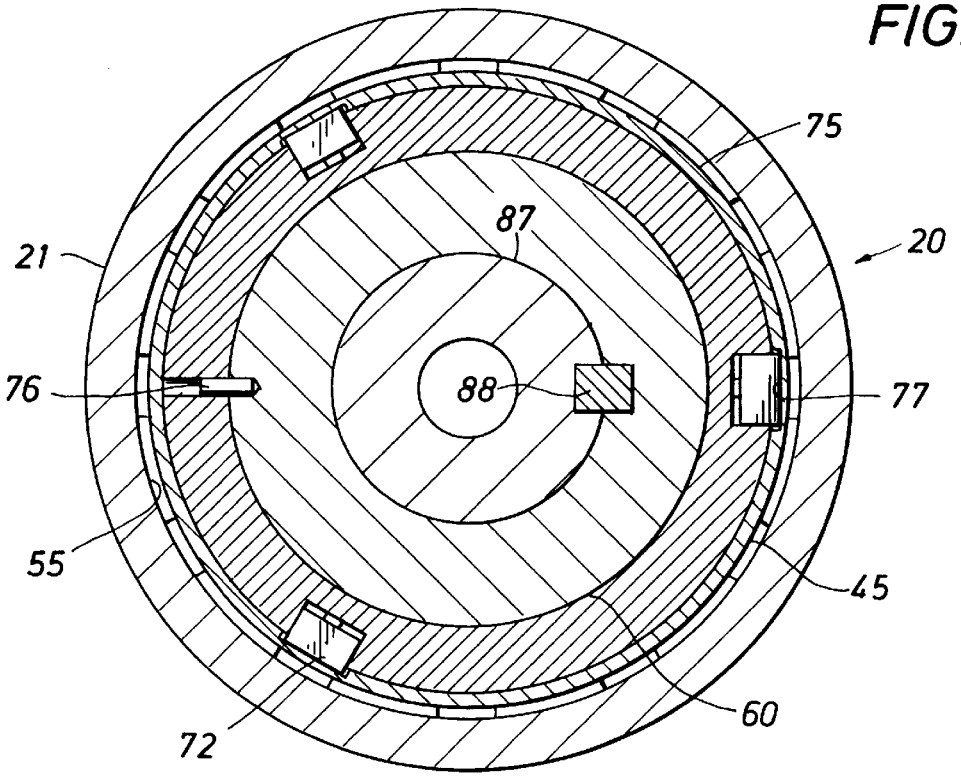
Figure 7:
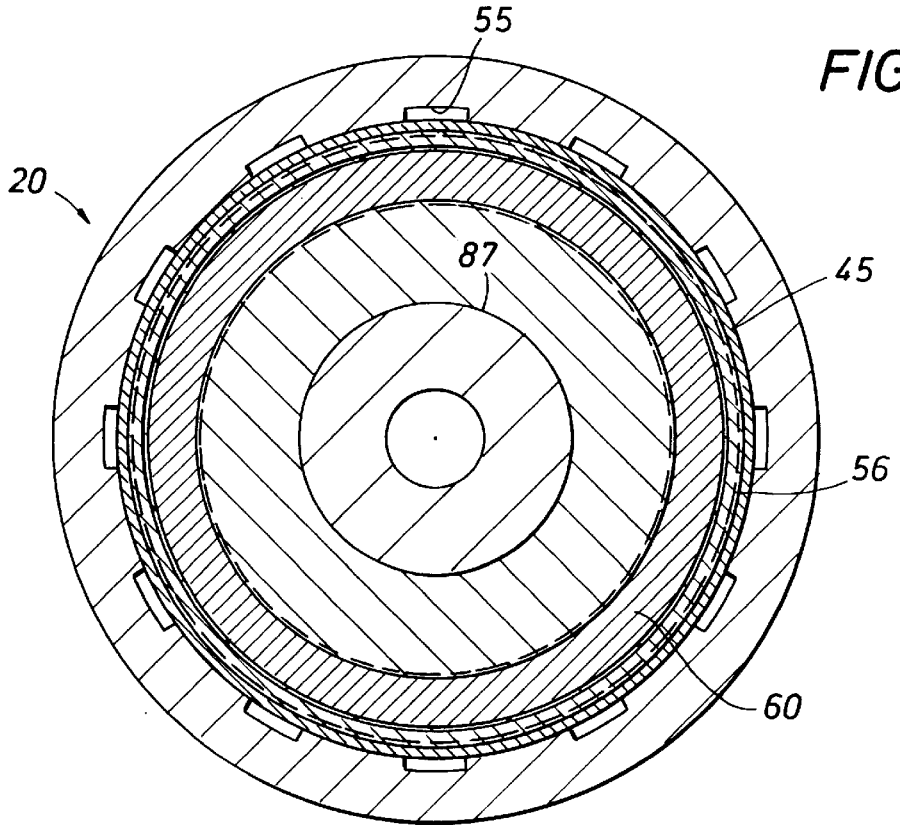
Figure 8:
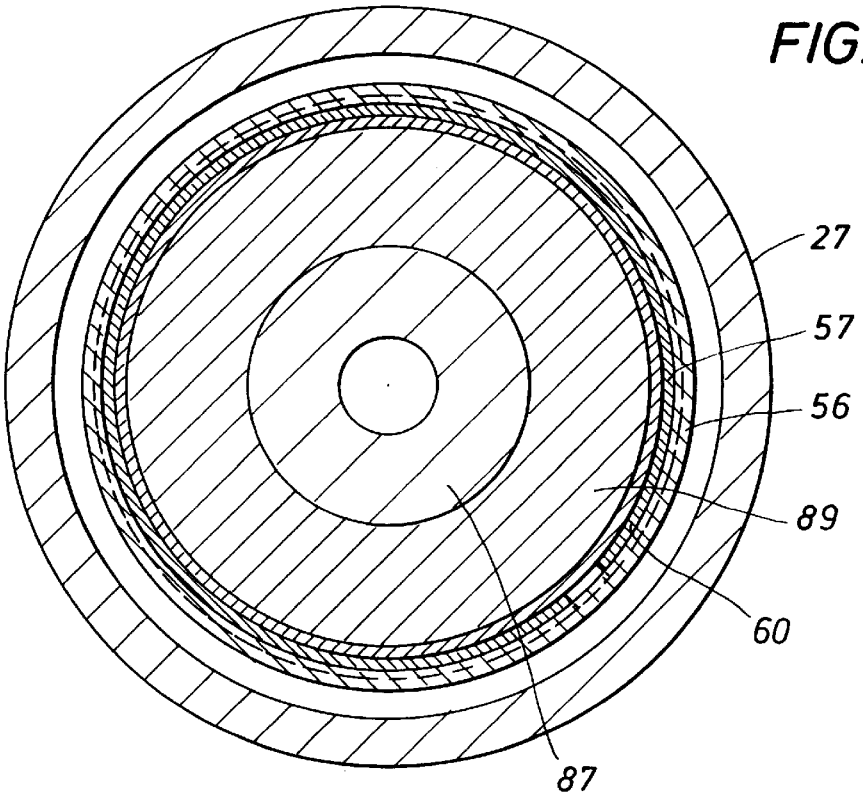
Figure 9:
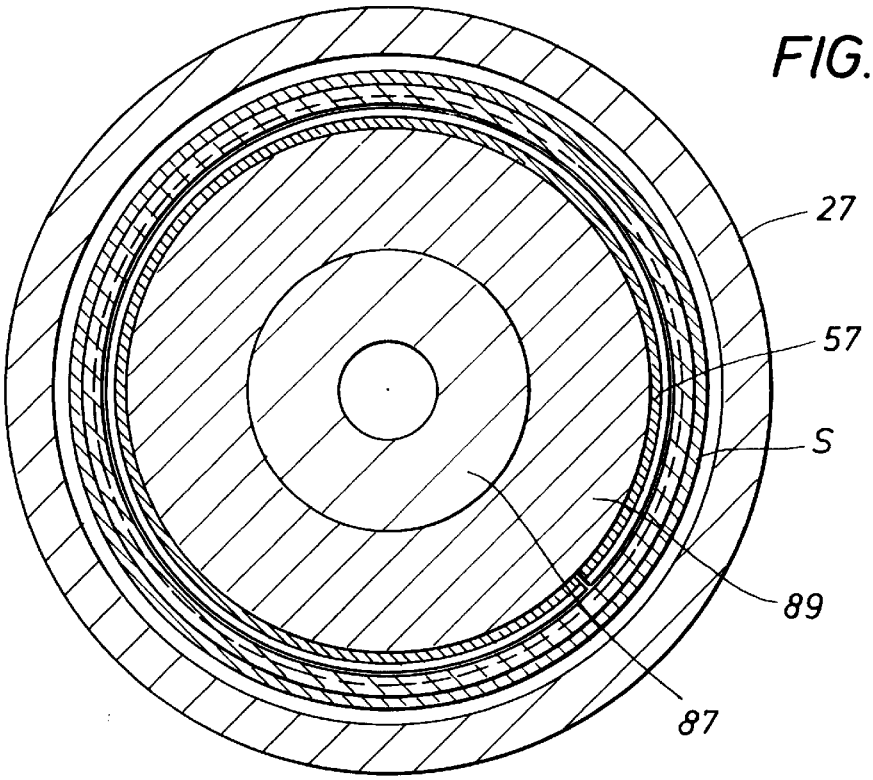
Figure 10:
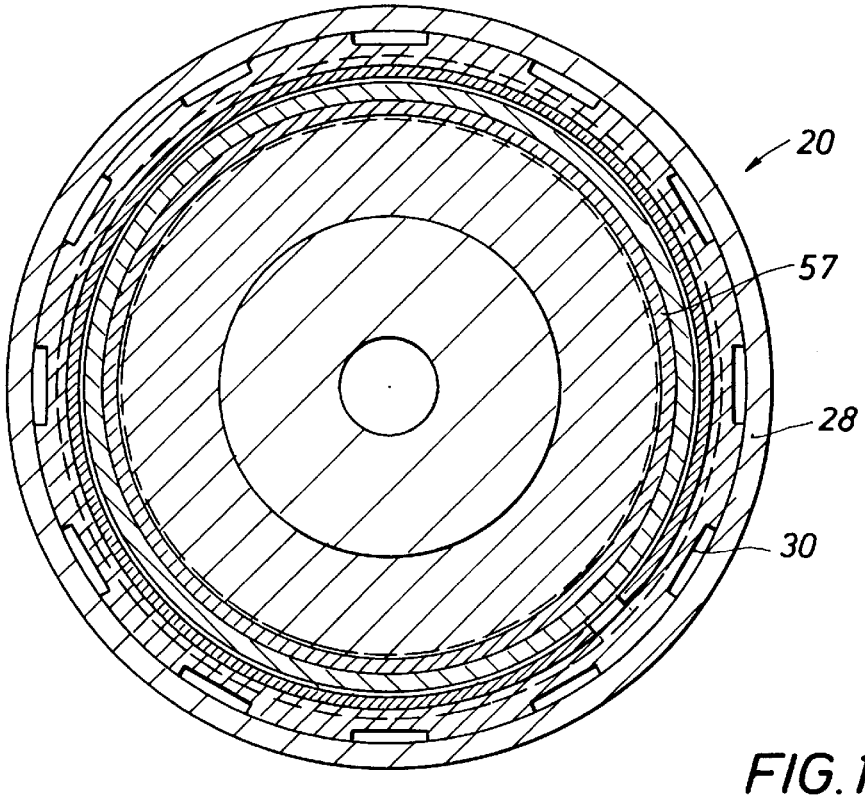
Figure 11:
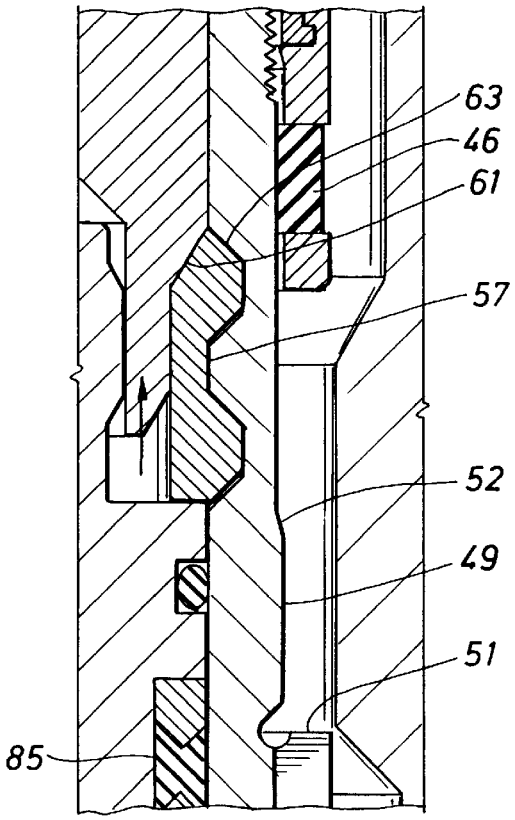
Figure 12:
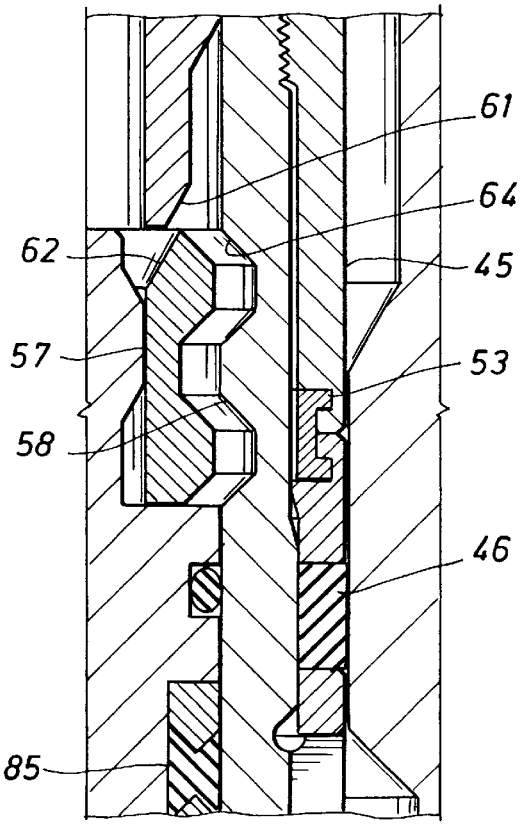

FIGS. 6, 7, and 8 are cross-sectional views of the running tool hanger and housing, as seen along broken lines 6—6, 7—7 and 8—8, respectively, of FIG. 1;

FIGS. 9 and 10 are cross-sectional views of the running tool, hanger and housing, as seen along broken lines 9—9 and 10—10, respectively, of FIG. 4, and FIGS. 11 and 12 are enlarged, partial, sectional views of the housing hanger and running tool in the positions of FIGS. 3 and 4.

With reference now to details of the above described drawings, the housing, indicated in its entirety by reference character 20, is connected to the upper end of an outer casing string 21 (FIG. 1) and has a bore 22 therethrough in which a casing hanger 23 is installed to suspend an inner casing string 24 (FIG. 1) connected to its lower end within the outer casing string 21. There is annular space between the casing strings through which, as will be described to follow, cement may be circulated upwardly between the hanger and bore of the casing hanger to anchor the inner casing string within the outer casing string. The apparatus further includes a running tool, indicated in its entirety by reference character L to which the hanger is latched for lowering into a position in which it is landed and locked within the bore of-the housing.

The housing, which is indicated by reference character 26, includes a main tubular member 27 and a tubular insert 28 threadedly connected at 29 within a lower recess in the main tubular member 27. As shown, the outer diameter of the insert has vertical slots 30 formed therein which are open at their upper and lower ends so as to permit cement to be circulated through the lower bypass formed thereby. Locking groove 35 is formed in the inner diameter of housing insert 28 adjacent its upper end and above an upwardly facing shoulder 34 in the bore.

As previously described, the hanger includes a mandrel 33 to which the upper end of the inner casing string 24 is connected, and an expandable and contractible split locking ring 36 carried about the hanger mandrel. In addition, a sleeve 38 is releasably connected by means of a shear pin 39 to the outer diameter of the mandrel beneath the recess and thus beneath the lock ring 36 but above shoulder 34 so as to initially locate the lock ring opposite the groove. The hanger also carries a guide ring 40 there about which fits closely within the bore of insert 28 to maintain it concentrically therein.

Figure 2:
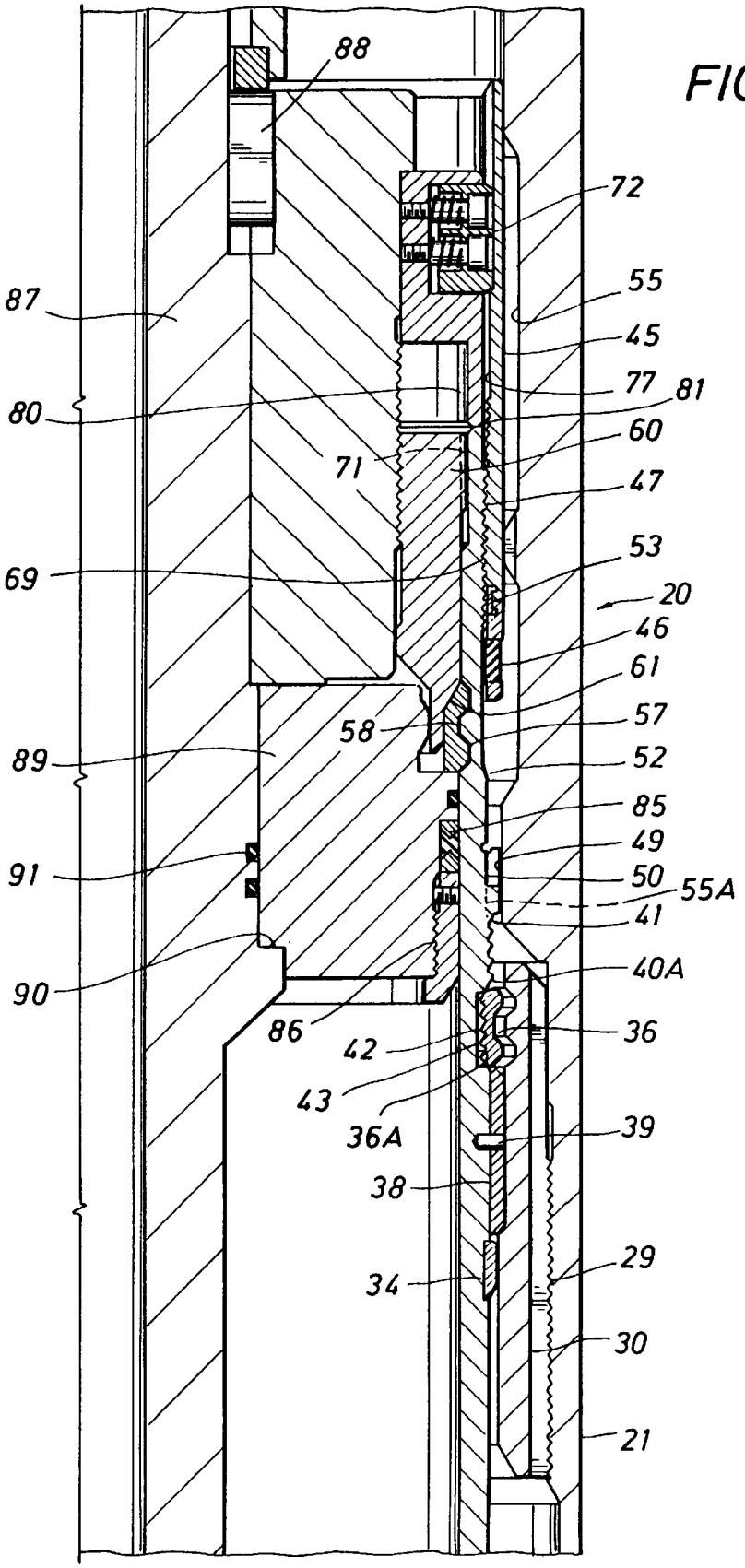
FIG. 2 is a partial view of the apparatus similar to FIG. 1, but on a somewhat enlarged scale.

The lock ring 36 is normally contracted into recess 36A so that the hanger is freely moveable downwardly into the position shown in FIG. 2. Upon reaching the FIG. 2 position, weight is imposed upon the hanger so as to shear the pin 39 and thus permit the locking mandrel and lock ring to move downwardly to the illustrated positions in which the lock ring may be forced out of groove 36A and into the lock groove 35 and then held it in such position. For this latter purpose, the hanger mandrel has a downwardly and inwardly tapered cam surface 40A, which, as the mandrel is moved further, forces the ring into locked position within the locking groove until a downwardly facing shoulder 41 on the mandrel above its recess lands on the upper end of the locking ring, as shown in FIG. 3.

The locking groove has upwardly facing load surfaces which are engaged by the downwardly facing load surfaces of the lock ring whereby, as previously mentioned, the load of the hanger, and that to be imposed by test pressure, is transmitted from the hanger, through the lock ring and onto the housing bore. Ratchet teeth 42 and 43 are formed on the inner diameter of the locking ring and outer diameter of the mandrel beneath its surface 41 so as to prevent upward movement of the hanger from its locked position as well as to permit the operating string to impose tension on the running tool to test the lock. It will be understood of course that the locking ring has sufficient clearance in the groove and flexibility to permit the ratchet teeth to move into ratcheted position.

As previously described, the hanger also includes a sleeve 45 which carries a elastomeric seal ring 46 and whose inner diameter is threadedly connected at 47 to the outer diameter of the hanger mandrel. When the mandrel is locked within the housing bore, the seal sleeve occupies an upper position in which the seal ring 46 is above an annular space S formed between oppositely facing annular seal surfaces 49 and 50 on the outer diameter of the mandrel and intermediate bore portion of the housing. As will be described to follow, upon manipulation of the running tool, the sleeve is lowered to move its seal ring 46 into the space for sealing between the seal surfaces.

Preferably, the mandrel has an upwardly facing shoulder 51 above the lock ring in position to be engaged by the seal sleeve as it is lowered into the space, whereby continued lowering of the seal sleeve, following seating on the shoulder, will cause the seal ring to be compressed and thus sealably engaged with both sealing surfaces to close the space. As also illustrated, the seal ring 46 is disposed between upper and lower portions of the sleeve, and a downwardly and outwardly extending flared surface 52 (FIG. 2)is formed on the outer diameter of the hanger mandrel above its seal surface thereon so as to stretch the seal ring tightly over it, as it moves into the space, as best shown in FIG. 12. Also, the upper end of the sleeve comprises upper and lower parts connected in end-to-end relation by means of a ring 53 which permits them to rotate relative to one another, whereby the seal ring need not rotate with the upper end of the seal sleeve as it is moved into sealing position.

Prior to lowering the seal ring, cement may be circulated upwardly through the bypass slots in the housing insert and into and through the annular space 5 and then upwardly within bypass slots 55 formed in the housing bore about the sleeve. As shown, the outer diameter of the hanger mandrel beneath the shoulder is slotted at 55A as to facilitate flow between the bypass formed by slots 30 and the annular space.

Figure 5:
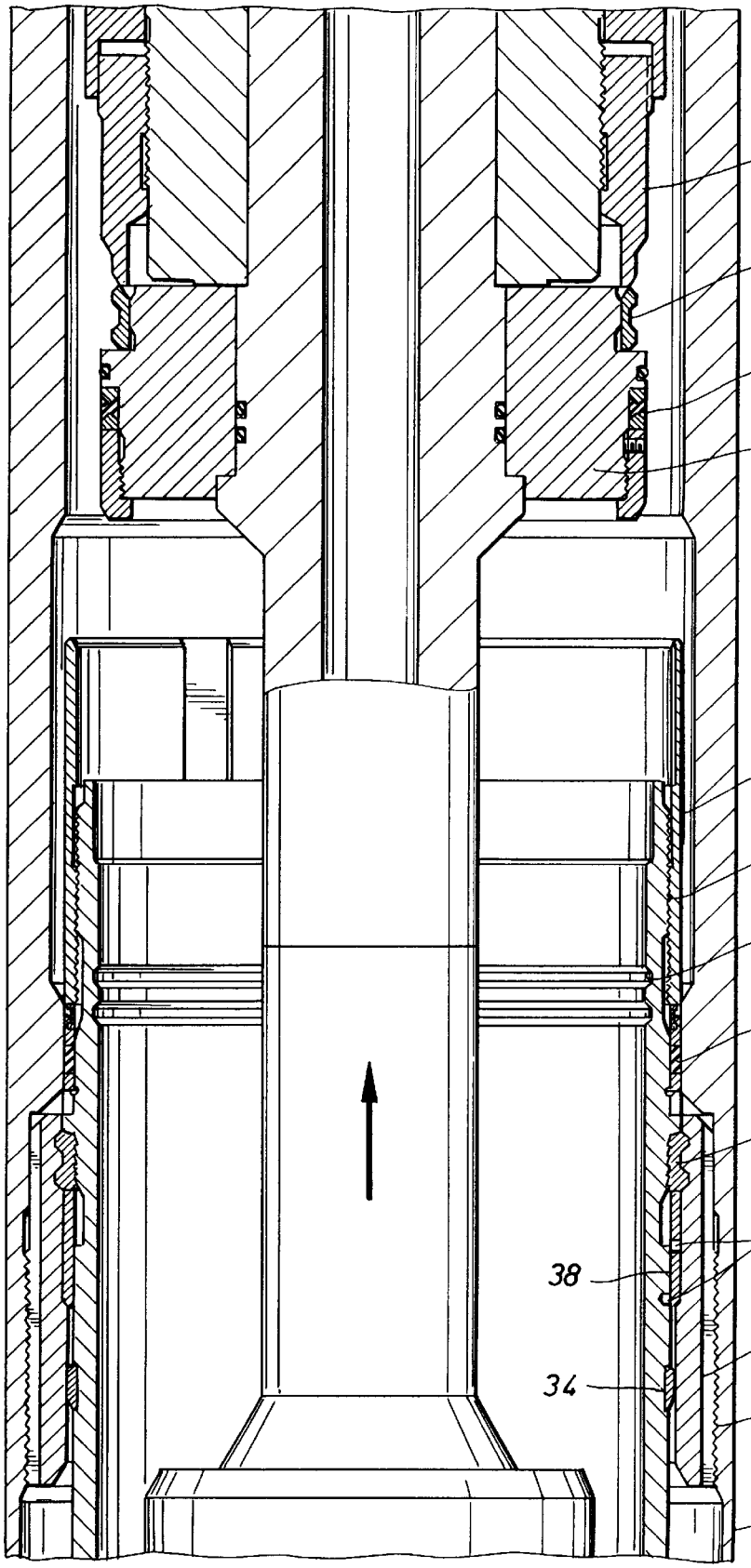
FIG. 5 is a view similar to FIG. 4, but showing the released running tool as it is raised from the hanger.

The running tool T is shown to comprise a body 56 carried about a well pipe 56A for rotation therewith and releasably connected to the mandrel hanger by means of a split latch ring 57 on the tool body engageable within a latch groove 58 in the bore of the hanger mandrel. As shown, the latch ring is carried about the running tool body for radial expansion and contraction between its latching position in which it may lower the hanger therewith and its released position of FIG. 12, which enables the tool to be inserted within or withdrawn from within the hanger for retrieval from the well bore, as shown in FIG. 5.

The latch ring is held in latching position by means of a cylindrical expander 60 carried about the body of the tool for vertical movement between a lower position in which it fits between the body and the latch ring to hold the latch ring in latching position, and an upper position in which it permits the split latch ring to contract to and thus permit installation of the running tool. As the expander is moved downwardly from its releasing position, a downwardly and inwardly facing cam surface 61 thereon engages a similarly tapered surface 62 on the upper end of the latch ring 57 to force the latch ring outwardly into the latch groove 58 in the mandrel of the hanger and hold it in such position as a lower cylindrical end the expander moves into the cylindrical inner diameter of the ring. In this position, downwardly and inwardly tapered load surface 63 thereon is engageable with the similarly tapered load surface 64 on the latch groove so as to support the hanger and inner casing string from the running tool.

However, and as best shown in FIG. 11, the tolerances are such that, with the tool body supported on the upper end of the hanger, the downwardly facing surfaces on the inner side of the latch ring are spaced from the oppositely facing surfaces of the groove, so that downward load of the hanger and string, as well as the force of test pressure, are transmitted through the lock ring, as previously described.

The inner diameter of the expander is threadedly connected at 69 to the outer diameter of the body of the running tool and has ribs 70 in its outer diameter at to fit closely within slots 71 formed in the inner diameter of the hanger mandrel. Thus, rotation of the running tool in one direction will move the expander downwardly to expanding position, and in the opposite direction will raise the expander from latching position. The expander is initially lowered to latch the tool to the hanger at the surface 50 that the hanger may be lowered therewith into the bore of the housing until the locating sleeve seats on the upper end of the shoulder 34, whereby downward force may be applied through the running tool to shear the pin 39 and thus release the locating sleeve and permit the locking ring to be moved into locking position within the bore of the housing.

The seal sleeve 45 is connected to the running tool for rotation therewith and vertical movement with respect thereto by means of keys 72 which are carried within guideways in a collar 75 which is connected to the tool body by a pin 76. The keys are yieldably urged (see FIG. 2) outwardly into slots 77 in the inner diameter of the seal sleeve to permit relative vertical movement between them. As previously described, the inner diameter of the seal sleeve is threadedly connected at 69 to the outer mandrel of the casing hanger mandrel generally opposite the upper bypass slots 55 in the bore of the housing so as to be m movable downwardly into the space by rotation of tool. As shown, the collar has a lower extension 80 which, upon latching of the running tool to the hanger mandrel, engages the upper end 81 of the hanger mandrel, whereby keys are located opposite the latch groove about the casing mandrel.

The threads connecting the expander 60 to the body of the running tool, and those connecting the seal sleeve to the mandrel, are so arranged that, upon installation of the hanger on the running tool, the seal sleeve is in its upper position above the space between the hanger mandrel and the housing bore, as shown in FIG. 2. This of course can be accomplished at the surface by the rotation of the body of the running tool in one rotational direction so as to simultaneously move the expander downwardly to force the latch ring 57 into the latch groove of the hanger mandrel while raising the seal sleeve to its raised position.

Figure 3A:
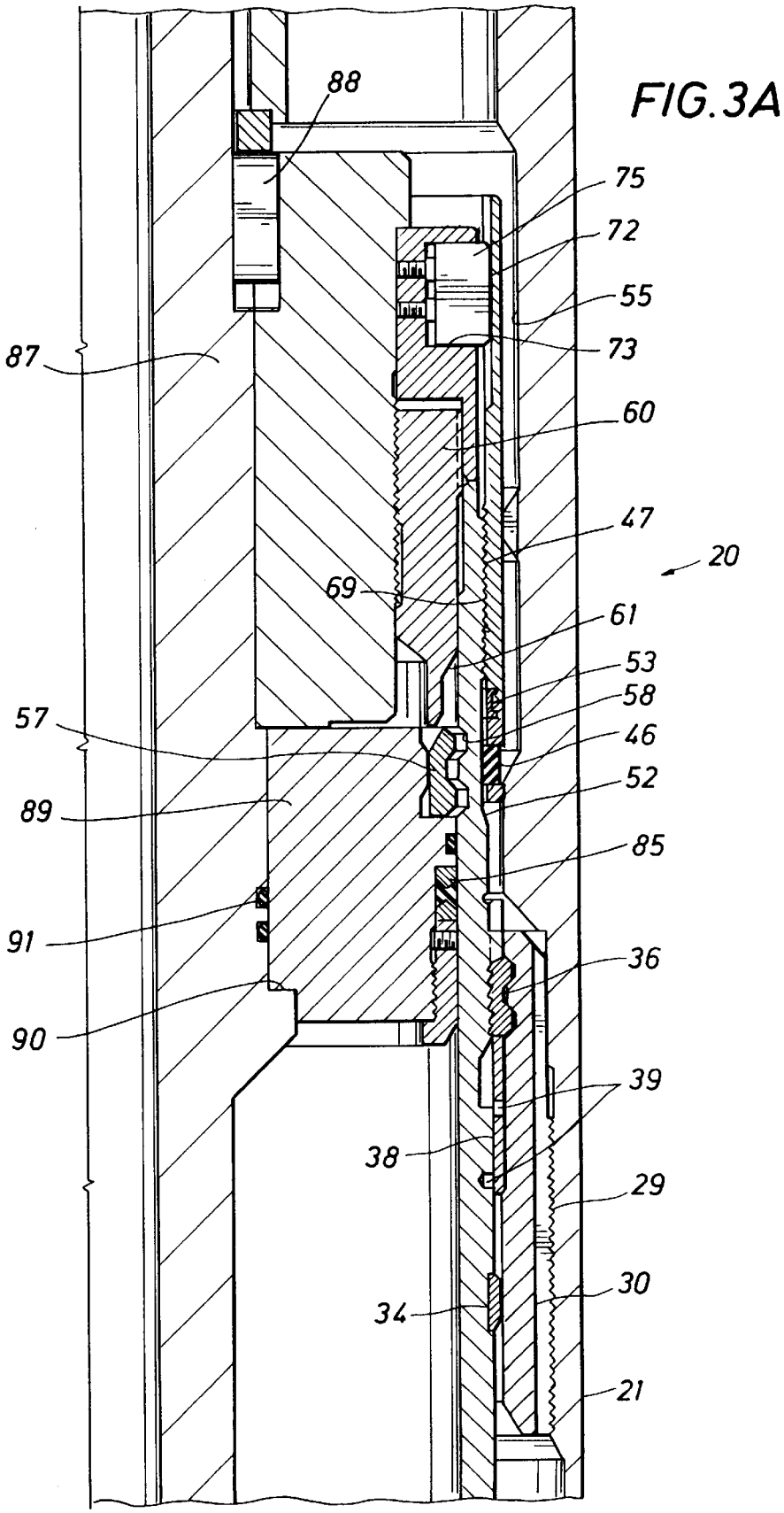
FIG. 3A is a view similar to FIG. 3, but following the cementing operation and actuation of the running tool to unlatch it from the hanger and lower the seal sleeve toward its position to close the annular space.

With the mandrel lowered into and locked within the housing bore, reverse rotation of the running tool body will raise the expander 60 to release the latch ring 57 and move the seal sleeve downwardly toward sealing position within the space between the hanger mandrel and housing bore (FIG. 4). As best shown in FIG. 3A, the threaded connections are so arranged as to raise the expander to release the latch ring from the hanger mandrel before the seal sleeve is lowered to fully compress the seal ring, thus assuring that the running tool can be retrieved even though the space between the mandrel and the housing bore is not fully closed. At the same time, it enables the running tool to apply full torque to compress the seal ring.

The body of the running tool is recessed about its lower end to carry a seal 85 for sealably engaging the bore of the mandrel when the, mandrel is assembled on the tool. This seal ring 85 is held in place by a retainer ring,86 threadedly connected to the lower end of the recess. Thus, the seal cooperates with the seal ring 46 to close off the annular space between the running string and housing bore 50 that it may be tested by pressure from above.

Preferably, and as shown, the tool body is made up of a main upper portion 87 which is mounted for rotation with the pipe string by means of keys 88, and a lower portion 89 of the body is supported on a shoulder 90 about the pipe string. The latch ring 57 and seal rings are supported on the lower end of a reduced diameter portion at the upper end of the lower body portion, and seal rings 91 on the pipe complete closure of the space. Thus, the pipe string and upper portion of the body of the running tool may be rotated without rotation of the latch ring and seal ring 85.

From the foregoing it will be seen that this invention is one well adapted to attain all of the ends and objects herein above set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Wellhead apparatus, comprising a housing having a bore therethrough and a lower end connectible to an outer casing string for extension within a well bore, an upwardly facing shoulder in the bore, a locking groove in the bore above the shoulder and having an upwardly facing load surface, and a lower fluid bypass means connecting with the bore above and below the groove, a casing hanger including a mandrel having a bore therethrough and a lower end connectible to an inner casing string for suspension within the outer casing string, a recess about the outer diameter of the mandrel, a radially expandable and contractible locking ring carried within the recess, a downwardly facing cam surface above the recess, and means connected to the mandrel for landing on the shoulder in the housing bore to locate the locking ring opposite the locking groove therein, and being releasable, in response to downward force on the mandrel, to permit the mandrel to move downwardly with respect to the housing and locking ring so as to move the locking ring outwardly into and hold it in an expanded position within the groove in which a downwardly facing load surface on the ring is adapted to seat upon an upwardly facing load surface on the groove to support downward loads, said housing bore and mandrel forming an annular space between cylindrical seal surfaces thereon which form an upward continuation of the fluid bypass means, and a sleeve carrying a seal ring and connected about the casing hanger mandrel for vertical movement within the housing bore, in response to lowering of the sleeve, between an upper position in which the seal ring is above the annular space to form upward continuation of the fluid bypass means, and a lower position in which the ring is in sealing engagement with the seal surfaces to close the space, the bore of the housing having a second fluid bypass means outside the sleeve to form an upward continuation of the space.

2. Wellhead apparatus as in claim 1, wherein said mandrel is threadedly connected to the inner diameter of the sleeve and has a latch groove below a slot in its bore, and including a running tool having a body adapted to be suspended from a pipe string for rotation and vertical movement therewith within the well bore, and a downwardly facing load surface for seating on the upper end of the mandrel, a radially expandable and contractible latch ring carried about the body and having an upwardly facing load surface, and expander means threadedly connected about the body and having a rib slidable within the slot in the hanger to cause the expander means to be moved vertically, in response to rotation of the body, between an upper position in which the latch ring is free to contract and a lower position in which the latch ring is expanded and held within the groove, said groove having a downwardly facing load surface engageable by an upwardly facing load surface on the latch ring so as to support the mandrel from the tool as it is lowered within the well bore.

3. Wellhead apparatus as in claim 1, wherein the mandrel is threadedly connected to the inner diameter of the sleeve, and the sleeve has a vertical slot in its inner diameter, and including a running tool having a body adapted to be suspended from a pipe string for rotation and vertical movement therewith within the well bore and having a downwardly facing load surface which seats on the upper end of the mandrel, means on the body and mandrel for latching the tool to the hanger mandrel when the body is so seated, and, a key carried by the body for rotation therewith and vertically slidable within the slot in the sleeve so as to lower the sleeve into the space between the sealing surfaces of the mandrel and housing bore upon rotation of the body.

4. Wellhead apparatus as in claim 2, wherein the sleeve has a vertical slot in its inner diameter, and the running tool body also has a collar rotatable therewith and on which the downwardly facing load surface is formed for seating on the upper end of the mandrel, and a key carried by the collar for rotation therewith and guidably sliding within the slot in the sleeve so as to lower the sleeve into the space between the sealing surfaces of the mandrel and housing bore upon rotation of the tool body.

5. As in claim 4, wherein the threaded connection of the sleeve to the mandrel and the body to the expander means are arranged to release the latch ring from the latch groove before the seal ring is in sealing position to close the space.

6. As in claim 1, wherein the housing includes a main tubular portion for connection to the outer casing string, and a tubular insert connected to the main body portion within a recess thereof below the annular space and having slots in its outer diameter to form the by pass.

7. As in claim 1, wherein the seal surface on the housing bore is essentially the same diameter as the minimum diameter of the housing above and below the bypasses.

8. As in claim 1, wherein ratchet teeth are formed on the locking ring and the hanger mandrel to prevent movement of the hanger from locking to unlocking position.

9. As in claim 1, wherein the hanger mandrel includes a tubular member connectible to the inner casing and the means for locating the ring opposite the locking grooves comprises a locating sleeve releasably connected to the mandrel beneath the lower end of the lock ring.

10. As in claim 1, wherein the hanger has a downwardly and outwardly tapered conical surface above its seal surface over which the seal is expanded as it is lowered into the space.

11. As in any one of claim 2, 3, or 4, wherein the running tool body includes a main portion to which pipe is connected for rotation therewith, and a lower portion which is free to rotate with respect to the main portion, and means are provided for sealing between the lower portion and the mandrel bore.

12. As in claim 11, wherein the latch ring is supported on the lower body portion of the running tool.

* * * * *